US006764315B2

(12) United States Patent
Ng et al.

(10) Patent No.: US 6,764,315 B2
(45) Date of Patent: Jul. 20, 2004

(54) ELECTRICAL CONNECTOR

(75) Inventors: Kiat-Hup Joey Ng, Singapore (SG); Lip Teck Soh, Skudai (MY)

(73) Assignee: FCI, Paris (FR)

( * ) Notice: Subject to any disclaimer, the term of this patent is extended or adjusted under 35 U.S.C. 154(b) by 0 days.

(21) Appl. No.: 10/324,924

(22) Filed: Dec. 20, 2002

(65) Prior Publication Data

US 2003/0124879 A1 Jul. 3, 2003

(51) Int. Cl.[7] ..... H01R 13/648
(52) U.S. Cl. ..... 439/66; 439/101; 439/608
(58) Field of Search ..... 439/66, 91, 608, 439/101, 108, 74

(56) References Cited

U.S. PATENT DOCUMENTS 6,210,182 B1 * 4/2001 Elco et al. ..... 439/101
6,247,970 B1 * 6/2001 Ueno et al. ..... 439/108
6,250,935 B1 * 6/2001 Mochizuki et al. ..... 439/608
6,276,941 B1 * 8/2001 Wu ..... 439/66
6,305,948 B1 * 10/2001 Wu ..... 439/66
6,379,165 B1 * 4/2002 Lee ..... 439/108
6,386,889 B1 * 5/2002 Bishop ..... 439/66

FOREIGN PATENT DOCUMENTS

JP 10/106684 4/1998
WO WO 98/09354 3/1998

* cited by examiner

*Primary Examiner*—Gary Paumen
(74) *Attorney, Agent, or Firm*—Perman & Green, LLP

(57) ABSTRACT

A connector to provide interconnection between two devices which each present electrical connection points for a signal and ground circuit and between which the connector is to provide electrical connection. A housing is provided having a first region retaining a conductive element and a second region retaining a further conductive element. Each conductive element has a first and a second contact point for engagement to electrical connection points for a signal circuit between the two devices. The conductive elements are resiliently deflectable for compression engaged by and between the two devices. A plate is positioned between the first region and the second region and includes a contact region to engage with an electrical connection point for a ground circuit of the first device and a contact region to engage with an electrical connection point of a ground circuit of the second device to also be contacted in a resiliently deflectable manner.

24 Claims, 2 Drawing Sheets

ELECTRICAL CONNECTOR

TECHNICAL FIELD

The present invention relates to an electrical connector and in particular to an electrical connector which includes a shield for reducing signal interference.

BACKGROUND

Electrical connectors such as those typified as compression connectors are well known. Such connectors provide a housing normally of an insulative material which locates a plurality of conductive elements. The conductive elements provide a path for the flow of electricity between two devices between which the connector is positioned. The conductive elements normally consist of an element which has at least two contact regions. The contact regions are provided to each engage with electrical traces such as those found on printed circuit boards.

Often the conductive elements are provided in arrays, placing them proximate to each other. With the advancement of technology the electrical signals passing through electrical connectors can reach significant rates and interference between respective arrays or between individual conductive elements can occur. Such interference can in fact distort the electrical signals. With the advancement of technology, the demands on electrical connectors are now such that the proximity of either the arrays of conductive elements or the conductive elements themselves is so small that the incidence of interference between conductive elements or arrays is increasing. To reduce such interference connectors are being provided with shielding. Normally such a shielding consists of a conductive plate interposed between the arrays of conductive elements. The shield is itself connected to an earth or ground circuit. With reference to WO98/09354, a shield is engaged to an earth or ground circuit provided by the two electrical devices.

Likewise in JP10-106684 there is disclosed a shield between an array of conductive elements wherein the shield is able to be connected to one of the devices between which the conductive elements provides the electrical signal connection.

Since the conductive elements providing the connection for the electrical signals are normally of a compressive connection type it would be desirable for the shield of such a connector to simultaneously and likewise be compressively engageable between the two devices.

Accordingly it is an object of the present invention to provide a connection which meets the abovementioned desiderata or which will at least provide the public with a useful choice.

BRIEF DESCRIPTION OF THE INVENTION

In a first aspect the present invention consists in a connector to provide interconnection between two devices which each present electrical connection points for a signal circuit and electrical connection points for a ground circuit between which said connector is to provide electrical connection said connector comprising a housing having a first region retaining at least one conductive element and a second region retaining at least one further conductive element, each conductive element having a first and a second contact point for engagement to a first and second said device respectively, each for interconnection between electrical connection points for a signal circuit, a shielding member providing a plate positioned between said first region and said second region, said shielding member including a first device contact region to engage with an electrical connection point for a ground circuit of said first device and a second device contact region to engage with an electrical connection point of a ground circuit of said second device, at least one of said first and second device contact regions presented for engagement by a respective device, from said plate in a resiliently deflectable manner.

Preferably shielding member is retained in a shielding member cavity of said housing and wherein said first device contact region and said second device contact region each extend through an opening of the shielding member cavity in said housing.

Preferably said first device contact region extends from said plate of said shielding member resiliently deflectable relative thereto.

Preferably said second device contact region is presented from said plate of said shielding member resiliently deflectable relative thereto.

Alternatively said second device contact region is rigidly presented from said plate of said shielding member.

Preferably said second device contact region is a leg which extends from said plate to engage with an electrical connection point of said second device in a pressure contact manner.

Preferably said pressure contact manner is achieved as a result of the compression of the shielding member between said first device and said second device when in operative engagement which said connection member.

Preferably said first and second contact points of each of said conductive elements simultaneously engaged in a compressive contact manner with respective electrical connection points for a signal circuit of said first and second device as the compressive engagement of the first and second device contact regions of said shield member engage with electrical connection points of said first and second device for said ground circuit.

Preferably the second device contact regions of said shielding member and the second contact points of said conductive elements are soldered with respective electrical connection points of said second device.

Preferably said leg of said shielding member extends laterally from the housing a manner to allow for a soldered contact to be established with said leg and a said electrical connection point for a ground circuit(s) of the second device.

Preferably said shield member includes at least two first device contact regions.

Preferably said shielding member provides at least two second device contact regions.

Preferably said second contact points of said conductive elements extend laterally from said housing to allow for a soldered engagement of respective electrical contact points of the signal circuit(s) said second device to be provided.

Preferably said first region includes a plurality of conductive elements arranged in an array and said second region includes a plurality of further conductive elements arranged in an array wherein the shielding member provides said plate between said two arrays.

Preferably each conductive element is of a kind housed in said cavity to present at least said first contact point to be displaceable relative to said housing in a resiliently flexible manner.

Preferably said shielding member is a substantially planar.

Preferably said shielding member is stamped from a sheet metal material.

Preferably said first device contact region is provided at or towards a distal end of an arm engaged in a cantilevered manner to said plate.

In a second aspect the present invention consists in a connector mounted on a printed circuit board for connecting electrical circuit traces on said printed circuit board with electrical connection points of an electrical device wherein said connector comprises, a housing having a first region retaining at least one conductive element and a second region retaining at least one further conductive element, each conductive element having a first contact point for engagement to said electrical contact point of said device, and a second contact point, engaged to an electrical circuit trace of said printed circuit board, each conductive element providing interconnection between such electrical connection points for a signal circuit, said first contact point presented from said housing to be engaged by said device in a resiliently deflectable manner, a shielding member providing a plate positioned between said first region and said second region, said shielding member including a device contact region to engage with an electrical connection point for a ground circuit of said device and a printed circuit board contact region engaged with an electrical connection point of a ground circuit of said printed circuit board, said device contact regions being resiliently deflectable relative said plate such that when said device is in operative engagement with said connector, said device contact region is deflected to be biased towards said device.

Preferably said said housing is a unitary.

Preferably said said housing is a moulded plastic unit.

Preferably said said connector is of a compression connection kind.

Preferably said said conductive elements present said first and second contact points in a resiliently flexible manner relative to said housing.

Preferably said said conductive elements present said first and second contact points in a resiliently flexible manner relative to said housing wherein when each engaged to a respective device, each first and second contact points of each conductive element is displaced towards.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

DETAILED DESCRIPTION OF A PREFERRED EMBODIMENT

Figure 4:
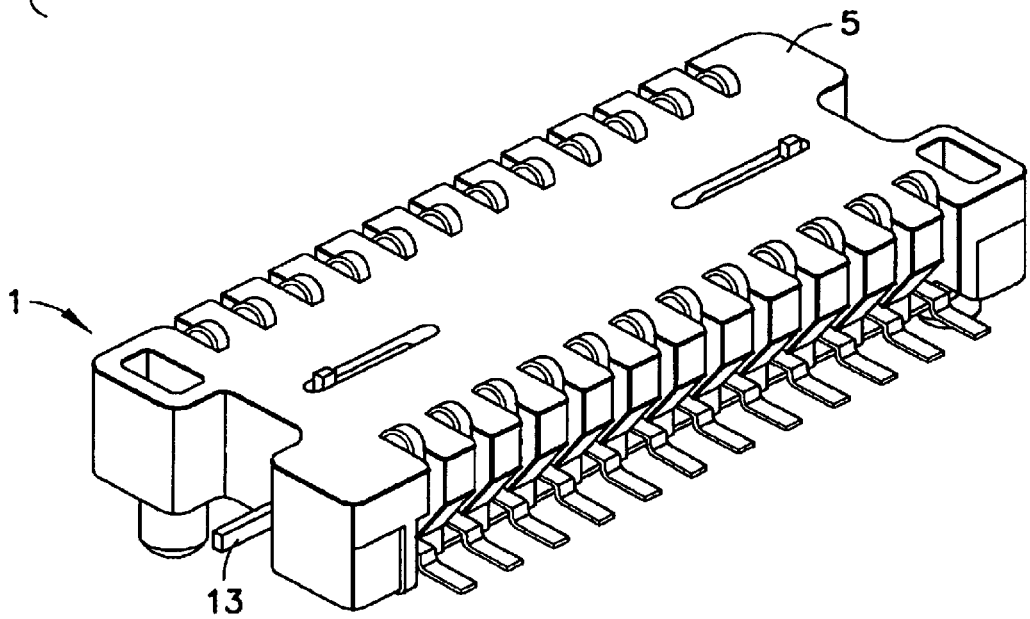
FIG. 4 is a perspective view of the connector of the present invention wherein the shielding member is in situ.

With reference to FIG. 4, there is shown a connector 1 which can be utilised for providing a connection between two electrical device. The two electrical devices may be for example be printed circuit boards forming part of an electric circuit of an overall electrical device such as for example a computer or the like. The term electric as used herein is to be interpreted to extend to electronic as well. Similarly the term circuit is to be interpreted broadly to include within the scope the fact that the electrical components not in all circumstances be provided to part of or to define a circuit. Indeed the devices may be precursors to the formation of an electrical circuit.

Figure 1:
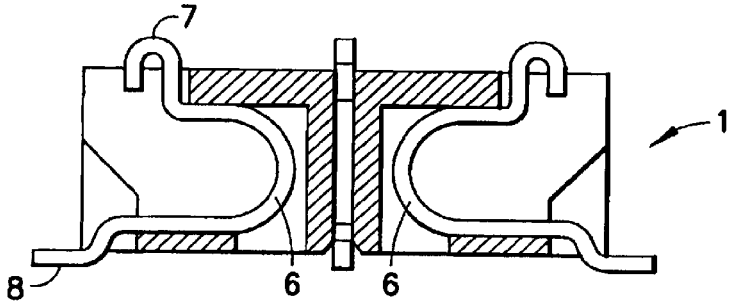
FIG. 1 is a sectional view through a connector of the present invention.

In the most preferred form the electrical devices are printed circuit boards forming part of an overall electrical device. The connector 1 of the present invention provides an interconnection for the flow of electricity between the two devices. In this form the connector provides a plurality of paths for the flow of electricity between the two devices however at least two paths for the flow of electricity may be provided as a minimum. The connector is to be positioned intermediate of the two electrical devices as for example shown in FIG. 2. The connector is preferably held in compression between the two devices. The first device 2 engages onto an upper portion of the connector and the second device 3 engages at a lower region (or side region) of the connector. The connector 1 may be provided as a unit engageable in succession between the first device 2 and the second device 3 or alternatively may be provided in a form where it is prefixed to for example second device 3 by soldering and by perhaps location lugs 4. The connector provides a housing 5 which locates a plurality of conductive elements 6 where the conductive elements are presented from the housing to be engaged by the first and second devices. The conductive elements are made of a conductive material and provide contact points to be engaged by electrical traces, wires or of points the first and second devices. With reference to FIG. 1, each conductive element provides a first contact point 7 and a second contact point 8 each engageable to the first device 2 and second device 3 respectively. Appropriate electrical traces on the printed circuit boards of the first and second electrical devices are positioned such that appropriate conductive elements will engage with an appropriate trace of each device to thereby provide for flow paths for electricity between the respective devices.

Preferably each of the conductive element is provided within a cavity of the housing wherein the cavity includes an opening for each of the first and second contact points to be presented through, for engagement with a respective device.

Figure 2:
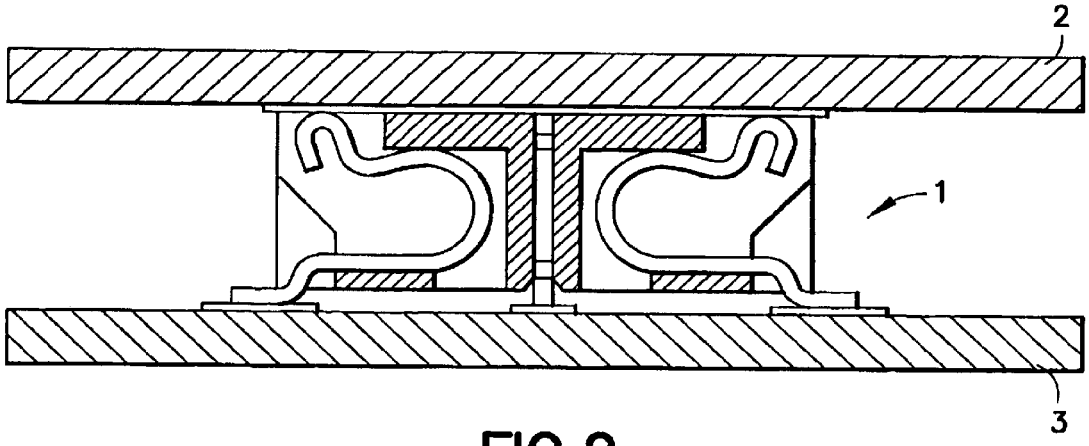
FIG. 2 is a sectional view through the connector of the present invention engaged with a first and second printed circuit board.

The conductive elements 6 are preferably of a kind which provide at least the first contact point 7 in a resiliently deflectable manner for engagement with and by the first device 2. As can be seen in FIGS. 1 and 2, upon engagement of the first device 2 the first contact points 7 is deflective downwardly. The contact may alternatively be deflected sideways where for example a plug/socket type of connection is provided for. In the form as shown however, the selection of material of the conductive element is such that it has good resistance to plastic deformation thereby enhancing the biasing force provided to the second contact point once the first device 2 is engaged, towards the first device 2. Such biasing creates a pressure contact of the first contact point with the first device thereby creating good connectivity.

The second contact point may be presented as part of the conductive element in a resiliently displaceable manner as well. However this may not be necessary and indeed the connector of the present invention may be provided in a form where it is pre-engaged to the second device 3. For example the second contact points may be soldered to the electrical traces of the printed circuit board of the second device 3. Alternatively however the deflectablity of one or both of the first and second contact points of the conductive elements may be relied upon during the engagement of the first and second devices with the connector for enhancing the connectivity of the first and second devices. Furthermore independent resilient deflectablity of the first and second contact points may also be provided by the configuration of the conductive elements as retained by the housing 1.

In the most preferred form the interconnection between the two devices is achieved by advancing the first device towards the second device with said connector intermediate thereof. As for example shown in FIG. 2, such direction of advancement may be normal to the general planar direction of the surfaces of the devices 2 and 3.

Figure 3:
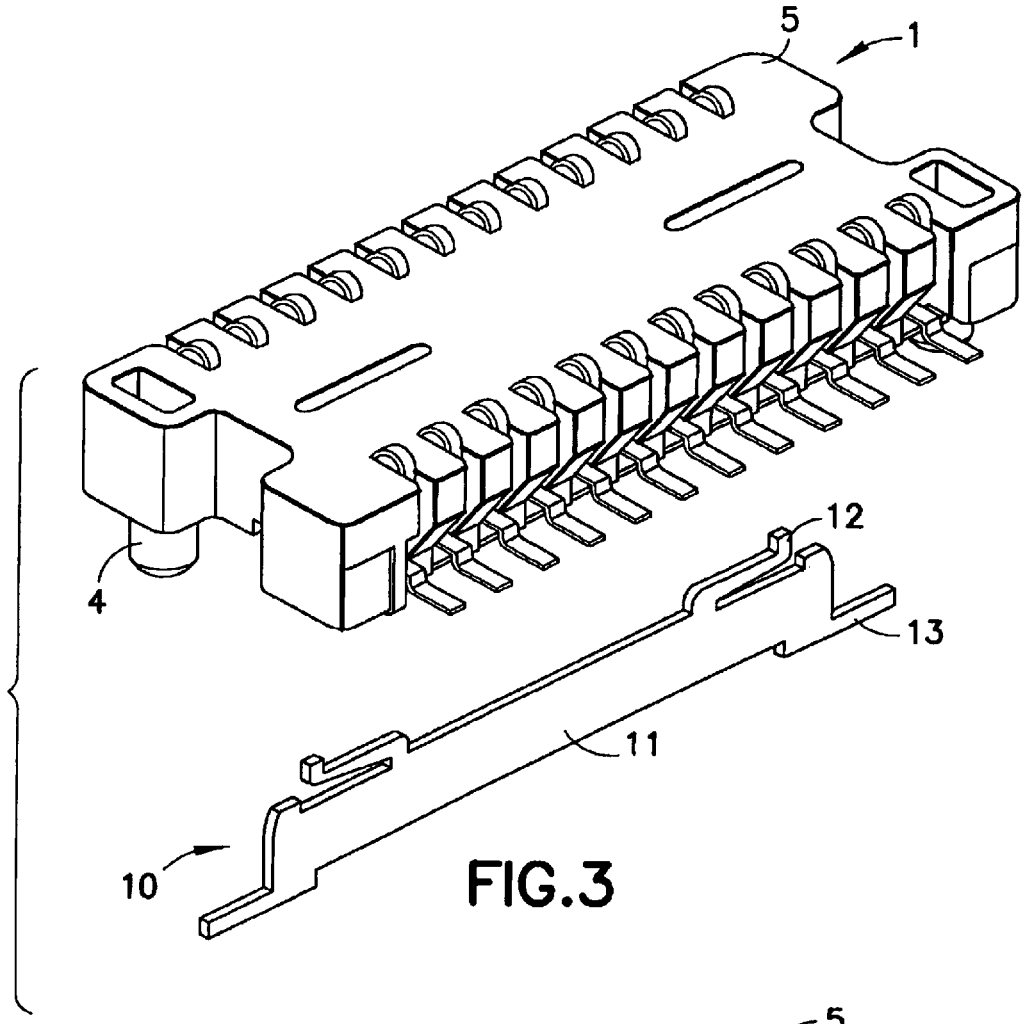
FIG. 3 is a perspective view of the connector of the present invention in an exploded view illustrating the preferred shape of the shielding member.

The at least two conductive elements are each provided within a region of the housing between which a shielding member 10 is provided. With reference to FIGS. 3 and 4, the regions preferably provide a plurality of conductive elements.

Whilst in the most preferred form the shielding member is provided between a first and second region each consisting of a plurality of conductive elements, alternatively such a shielding member may be provided intermediate of individual conductive elements.

The shielding member 10 consists of a plate 11 which is located intermediate of the conductive elements 6. The plate is sufficiently extensive enough to adequately reduce the transmission of electrical interference which may be transmitted between conductive elements between the first and second regions. The plate 11 is provided to extend between the first and second regions at least where the conductive elements of each region are most proximate.

Whilst the conductive elements provide interconnection for the flow of electricity between the two devices for signal circuit or circuits, the shielding member requires, in order to be effective, to become engaged with a ground circuit provided by both the first and second devices. Like the conductive elements the shielding member 10 may be provided in the form where it is pre-engaged with a ground circuit trace of the printed circuit board of the second device 3 or where such connection is to later be made. Irrespective of whether the conductive elements are provided in a pre-connected state with the electrical traces of the second device, the shielding member preferably becomes engaged with an electrical trace of the ground circuit provided by the first device as a pressure contact. The shielding member provides at least one first device contact region 12 and at least one second device contact region 13. The first and second device contact regions 12, 13 are resiliently deflectable relative to each other. Such relative resilient deflectablity is preferably provided as a result of the first device contact region 13 being mounted in a resiliently deflectable manner from the plate 11. The second device contact regions 13 are preferably presented from the plate in a non deflectable manner however in an alternative form they may also be provided to be deflectable relative to the plate. The second device contact regions 13 are preferably legs which as for example shown in FIG. 4 can extend beyond the body of the housing 5 to allow these to be soldered to an electrical trace of the second device 3.

The first and second device contact regions may be independently resiliently flexible from said plate 11 or may alternatively be mutually dependable on each other for deflection.

In the most preferred form the first device contact region 12 is provided at or towards a distal end of an arm extending from said plate 11 in a cantilevered manner. The shielding member is preferably made of a metallic and conductive material which provides a good resistance to plastic deformation so that a resilient bias of the first device contact regions 12 can be maintained with the traces of the ground circuit of the first devices, once the two devices are in operative engagement with the connector. Whether or not the connector of the present invention is pre-engaged to the second device or is firstly engaged with the second device prior to the first device being engaged to the connector, a connection of the traces of the ground circuit and the traces of the signal circuit of the second device is to be able to be achieved simultaneously when the first device is advanced for engagement and operative use with the connector of the present invention.

With the provision of the shielding member intermediate of the first and second region providing the conductive elements, a suitable shielding effect can be provided where the connector is used in high speed electrical signal transmission requirements where an interference or transfer of noise may occur between the first and second region. The shielding effect can hence be obtained as a result of the connection of the first device 2 with the second device 3 as a result of the provision of the conductive elements of the connector of the present invention wherein simultaneously a connection for the shielding effect is provided by the shielding member 10. A grounding of the shielding member can if necessary be transmitted at the same time without allocating a contact as the ground transmission in addition to the contact for the signal transmission.

What is claimed is:

1. A connector to provide interconnection between two devices which each present electrical connection points for a signal circuit and electrical connection points for a ground circuit between which said connector is to provide electrical connection said connector comprising, a housing having a first region retaining at least one conductive element and a second region retaining at least one further conductive element, each conductive element having a first and a second contact point for engagement to electrical connection points for a signal circuit of said first and second said device respectively;

a shielding member providing a plate positioned between said first region and said second region, said shielding member including a first device contact region to engage with an electrical connection point for a ground circuit of said first device and a second device contact region to engage with an electrical connection point of a ground circuit of said second device;

at least one of said first and second device contact regions for engagement by a respective device extends, from said plate in a resiliently deflectable manner.

2. A connector as claimed in claim 1 wherein said shielding member is retained in a shielding member cavity of said housing and wherein said first device contact region and said second device contact region each extend through an opening of the shielding member cavity in said housing.

3. A connector as claimed in claim 1 wherein said first device contact region extends from said plate of said shielding member resiliently deflectable relative thereto.

4. A connector as claimed in claim 1 wherein said second device contact region is presented from said plate of said shielding member resiliently deflectable relative thereto.

5. A connector as claimed in claim 1 wherein said second device contact region is rigidly presented from said plate of said shielding member.

6. A connector as claimed in claim 1 wherein said second device contact region is a leg which extends from said plate to engage with an electrical connection point of said second device in a pressure contact manner.

7. A connector as claimed in claim 6 wherein said pressure contact manner is achieved as a result of the compression of the shielding member between said first device and said second device when in operative engagement which said connection member.

8. A connector as claimed in claim 1 wherein said first contact points of each of said conductive elements simultaneously engage in a compressive contact manner with respective electrical connection points for a signal circuit of said first device as the compressive engagement of the first device contact region of said shield member engages with electrical connection points of said first device for said ground circuit.

9. A connector as claimed in claim 1 wherein operative engagement the second device contact regions of said shielding member and the second contact points of said conductive elements are soldered with respective electrical connection points of the ground circuit of said second device.

10. A connector as claimed in claim 6 wherein said leg of said shielding member extends laterally from the housing in a manner to allow for a soldered contact to be established with said leg and a said electrical connection point for a ground circuit of the second device.

11. A connector as claimed in claim 1 wherein said shield member includes at least two first device contact regions.

12. A connector as claimed in claim 1 wherein said shielding member provides at least two second device contact regions.

13. A connector as claimed in claim 1 wherein said second contact points of said conductive elements extend laterally from said housing to allow for a soldered engagement of respective electrical contact points of the signal circuit(s) said second device to be provided.

14. A connector as claimed in claim 1 wherein said first region includes a plurality of conductive elements arranged in an array and said second region includes a plurality of further conductive elements arranged in an array wherein the shielding member provides said plate between said two arrays.

15. A connector as claimed in claim 1 wherein each conductive element is of a kind housed in said cavity to present said first contact points only to be displaceable relative to said housing in a resiliently flexible manner.

16. A connector as claimed in claim 1 wherein said shielding member is a substantially planar.

17. A connector as claimed in claim 1 wherein said shielding member is stamped from a sheet metal material.

18. A connector as claimed in claim 1 wherein said first device contact region is provided at or towards a distal end of an arm engaged in a cantilevered manner to said plate.

19. A connector mounted on a printed circuit board for connecting electrical circuit traces on said printed circuit board with electrical connection points of an electrical device to be brought into compressive engagement with said connector, wherein said connector comprises, a housing having a first region retaining at least one conductive element and a second region retaining at least one further conductive element, each conductive element having a first contact point for engagement to said electrical contact point of said device, and a second contact point, engaged to an electrical circuit trace of said printed circuit board, each conductive element providing interconnection between such electrical connection points for a signal circuit, said first contact point extends from said housing to be engaged by said device in a resiliently deflectable manner, a shielding member providing a plate positioned between said first region and said second region, said shielding member including a device contact region to engage with an electrical connection point for a ground circuit of said device and a printed circuit board contact region engaged with an electrical connection point of a ground circuit of said printed circuit board, said device contact regions being resiliently deflectable relative said plate such that when said device is in operative engagement with said connector, said device contact region is deflected to be biased towards said device.

20. A connector as claimed in claim 1 wherein said housing is a unitary.

21. A connector as claimed in claim 1 wherein said housing is a moulded plastic unit.

22. A connector as claimed in claim 1 wherein said connector is of a compression connection kind.

23. A connector as claimed in claim 22 wherein said conductive elements present said first and second contact points in a resiliently flexible manner relative to said housing.

24. A connector as claimed in claim 22 wherein said conductive elements present said first and second contact points in a resiliently flexible manner relative to said housing wherein when each engaged to a respective device, each first and second contact points of each conductive element is displaced towards.

* * * * *

UNITED STATES PATENT AND TRADEMARK OFFICE

CERTIFICATE OF CORRECTION

PATENT NO. : 6,764,315 B2
DATED : July 20, 2004
INVENTOR(S) : Ng et al.

It is certified that error appears in the above-identified patent and that said Letters Patent is hereby corrected as shown below:

Title page,
Add Item: -- [30] Foreign Application Priorty Data:
December 28, 2001,. Singapore, 200108115-7 --

Signed and Sealed this

Fourth Day of January, 2005

JON W. DUDAS
*Director of the United States Patent and Trademark Office*